US005142256A

United States Patent [19]

Kane

[11] Patent Number: 5,142,256

[45] Date of Patent: Aug. 25, 1992

[54] PIN DIODE WITH FIELD EMISSION DEVICE SWITCH

[75] Inventor: Robert C. Kane, Woodstock, Ill.

[73] Assignee: Motorola, Inc., Schaumburg, Ill.

[21] Appl. No.: 680,469

[22] Filed: Apr. 4, 1991

[51] Int. Cl.[5] ..... H01P 1/15

[52] U.S. Cl. ..... 333/262; 307/317.1; 333/263

[58] Field of Search ..... 333/103, 104, 81 A, 333/262, 263; 307/317.1, 304; 328/242

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,906,956 | 3/1990 | Kakihana | 333/263 X |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204911 | 11/1988 | United Kingdom . |

OTHER PUBLICATIONS

A Vacuum Field Effect Transistor Using Silicon Field Emitter Arrays, by Gray, 1986 IEDM.

Advanced Technology: flat cold-cathode CRTs, by Ivor Brodie, Information Display Jan. 1989.

Field-Emitter Arrays Applied to Vacuum Fluorescent Display, by Spindt et al. Jan. 1989 issue of IEEE Transactions on Electronic Devices.

Field Emission Cathode Array Development For High--Current Density Applications by Spindt et al., dated Aug. 1982 vol. 16 of Applications of Surface Science.

*Primary Examiner*—Paul Gensler

*Attorney, Agent, or Firm*—Eugene A. Parsons

[57] ABSTRACT

A PIN diode switch employing an active switching field emission device having high intrinsic isolation to high frequency and microwave frequency energy signals and exhibiting integratability is provided.

12 Claims, 2 Drawing Sheets

— PRIOR ART —

— PRIOR ART —

PIN DIODE WITH FIELD EMISSION DEVICE SWITCH

FIELD OF THE INVENTION

This invention relates generally to PIN diode switches and more particularly to a PIN diode switch employing a field emission device as the switching element.

BACKGROUND OF THE INVENTION

PIN diode switches are known in the art. In some instances PIN diode switches are employed in high frequency and microwave environments to preferentially direct the flow of high frequency and microwave energy. The inherent characteristics of PIN diodes, in particular, a high ratio of impedance to high frequency energy in the OFF state and a low ratio of impedance to high frequency energy in the ON state, make them suitable for a wide variety of applications in radio frequency (RF) and microwave power circuitry. A common requirement of a PIN diode employed as a switch is that a switching device/circuit must be operably coupled to the PIN diode. In the instance when a switching device/circuit is operably connected to a PIN diode in a circuit wherein high frequency energy also resides, the switching device/circuit must be suitably isolated with respect to the high frequency energy while maintaining an operably coupled environment for the switching of the PIN diode. High frequency isolation commonly employs a network of reactive components such as inductors and capacitors. This additional circuit requirement, the high frequency isolation network, is, in many instances, objectionable due to increased parts required, increased costs, increased circuit size, and reduced reliability.

Accordingly, there exists a need for a PIN switch that overcomes at least some of these shortcomings of the known art.

SUMMARY OF THE INVENTION

This need and others are substantially met through provision of a PIN diode impedance switching circuit comprised of: at least a first transmission line conductor; and at least a first PIN diode having at least first and second PIN diode device terminals wherein the first PIN diode device terminal is operably coupled to the at least first transmission line conductor and wherein the second PIN diode device terminal is operably coupled to a first externally provided potential; and at least a first field emission device having at least first and second device terminals wherein the first device terminal is operably coupled to the at least first transmission line conductor and wherein the second device terminal is operably coupled to a second externally provided potential.

In a first embodiment of the PIN diode with field emission device switch, the PIN diode impedance switching circuit is employed as a means of attenuating the propagation of high frequency and microwave energy along a transmission line.

In a second embodiment of the PIN diode with field emission device switch, the PIN diode impedance switching circuit is employed as an adaptive tuning mechanism.

BRIEF DESCRIPTION OF THE DRAWINGS

FIG. 7A is a schematic representation of a fourth embodiment of a PIN diode with FED switch in accordance with the present invention.

DETAILED DESCRIPTION OF A PREFERRED EMBODIMENT

Figure 1:
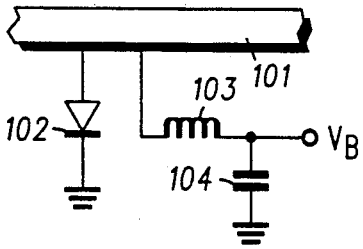
FIG. 1 is a schematic representation of a first embodiment of a circuit employing a PIN diode with switching network as is commonly employed in the prior art.

FIG. 1 depicts a first schematic representation of a PIN diode switch as is known in the prior art. A transmission line conductor (101), for propagating high frequency energy, is shown operably coupled to a first device terminal of a PIN diode (102), having the first and second device terminals, and a first device terminal of an inductor (103), having first and second device terminals. A first device terminal of a capacitor, having first and second device terminals, is operably coupled to the second device terminal of the inductor. The second device terminal of the capacitor (104) and the second device terminal of the PIN diode are each operably coupled to a common ground reference. Application of a particular external potential, herein referenced as $V_B$, will place the PIN diode in the ON state, presenting a low impedance at a location on the transmission line conductor (101) where the PIN diode is coupled. High frequency energy propagating on the transmission line, of which the transmission line conductor (101) is a functional part, is at least partially reflected at the location of the low impedance. So described, the PIN diode switch circuit of FIG. 1 may be employed as a high frequency energy attenuator and as a high frequency energy switch in addition to other known applications.

Figure 2:
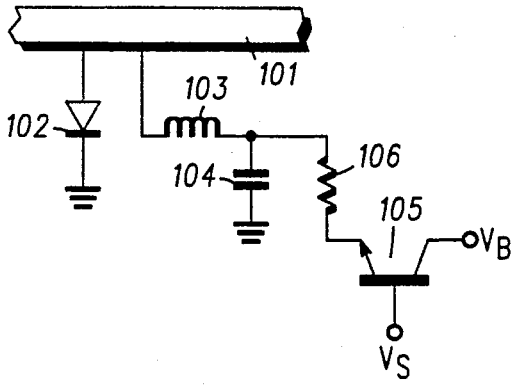
FIG. 2 is a schematic representation of a second embodiment of a circuit employing a PIN diode with switching network as is commonly employed in the prior art.

FIG. 2 is a second schematic representation of a PIN diode switch described previously with reference to FIG. 1, further comprising an active switching device (105), for example, a bipolar transistor as set forth. Other embodiments of PIN diode switches of the prior art may employ field-effect transistor switches. A resistive circuit element (106) having first and second device terminals is also employed wherein the first device terminal of the resistive circuit element of FIG. 2 is shown operably coupled to the second device terminal of the inductor (103) and wherein the second device terminal of the resistive circuit element is operably coupled to a depicted emitter of the active switching device (105). Application of a particular external potential to the collector of the active switching device (105), such as $V_B$, and an appropriate switching potential to the base of the active switching device (105), wherein the appropriate switching potential is referenced in FIG. 2 as $V_S$, places the active switching device (105) in the ON state and provides for a current flow through the PIN diode (102) by virtue of the potentials applied to/through the active switching device (105). So described, the PIN diode switch circuit of FIG. 2 may be employed as described previously with reference to FIG. 1.

Figure 3A:
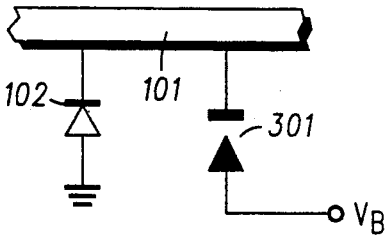
FIG. 3A is a schematic representation of a first embodiment of a PIN diode with FED switch in accordance with the present invention.

FIG. 3A illustrates a schematic representation of a first embodiment of a PIN diode switch in accordance with the present invention, wherein an active switching FED device (301), having first and second device terminals is employed. The first device terminal of the first and second device terminals of the active switching FED device (301) is operably coupled to the transmission line conducter (101). A PIN diode (102), having the first and second PIN diode device terminals, is provided wherein the first PIN diode device terminal of the PIN diode (102) is operably coupled to the transmission line conductor (101). The second PIN diode device terminal of the PIN diode (102) is shown operably coupled to a ground reference. When the second device terminal of the active switching device (301) is operably coupled to an externally provided potential, herein referenced as $V_B$, the active switching FED device (301) is placed in the ON node, providing current flow through the operably coupled PIN diode (102) such that the PIN diode (102) is placed in a low impedance ON state. The low impedance of the ON PIN diode (102) is presented to the transmission line conductor (101) at the location where the PIN diode (102) is operably coupled to the transmission line conductor (101). The switched ON PIN diode switch employing an active switching FED device (301) as described in FIG. 3A will perform substantially in a manner as described for the switch described previously with reference to FIG. 1, but not requiring an attendant high frequency energy isolation network such as described and utilized previously with reference to FIG. 1 and FIG. 2. Operating characteristics of FEDs include a high isolation capability. As such, FEDs may be employed in circuits without a need to provide high frequency isolation in addition to, and as protection for, the switching device, as is the case with switching circuits employing bipolar and semiconductor field-effect transistor devices.

Figure 3B:
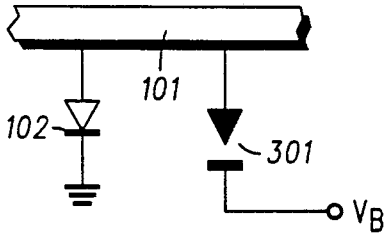
FIG. 3B is a schematic representation of a second embodiment of a PIN diode with FED switch in accordance with the present invention.

FIG. 3B is a schematic representation of a second embodiment of a PIN diode switch in accordance with the present invention wherein the PIN diode (102) is operably coupled to the transmission line conductor (101) opposite to the manner of operable coupling of the PIN diode (102) described previously with reference to FIG. 3A. Further, the active switching FED device (301) is depicted in FIG. 3B as having first and second device terminals operably coupled in reversed positions relative to the transmission line conductor (101) and the $V_B$ of the active switching FED device (301) previously described with reference to FIG. 3A. So coupled, the PIN diode switch of FIG. 3B will function substantially as described previously with reference to FIG. 3A and FIG. 1, provided a polarity of the externally provided potential, $V_B$, is opposite to that employed in the PIN diode switch described previously with reference to FIG. 3A.

Figure 4A:
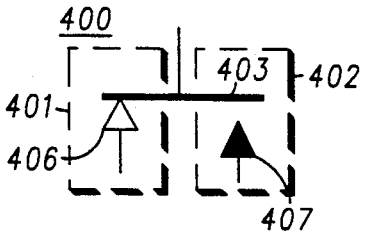
FIG. 4A is a first schematic diagram of a PIN diode with integral FED switch in accordance with the present invention.

FIG. 4A is a schematic diagram of a first embodiment of an integrated PIN switch (400) employing a PIN diode (401) and an FED active switching device (402) in accordance with the present invention. In the embodiment of FIG. 4A, the cathode of the PIN diode (401) is schematically depicted as being operably coupled to an anode of the FED active switching device (402) by a common schematic diagram element (403). An integrated PIN diode switch constructed in accordance with the depiction of FIG. 4A functions in the ON state when suitable potentials are substantially simultaneously applied to the PIN diode anode (406) and to the FED active switching device cathode (407). For example, application of a selected positive potential to the PIN diode anode (406) and a selected negative potential to the FED active switching device cathode (407) generates electron flow, substantially initiated at the cathode (407) of the FED active switching device (402), and then induced through each of the respective devices. Other methods of providing suitable operating potentials may include operably coupling one of the PIN diode anode (406) and FED active switching device cathode (407) to a ground reference. Typically, the integrated PIN switch (400) may be realized as a construction of the PIN diode (401) and the FED active switching device (402) in/on a single substrate material such as, for example, a semiconductor substrate.

Figure 4B:
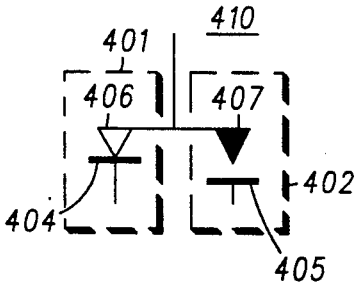
FIG. 4B is a second schematic diagram of a PIN diode with integral FED switch in accordance with the present invention.

FIG. 4B is a schematic diagram of a second embodiment of an integrated PIN switch (410) employing a PIN diode (401) and an FED active switching device (402). In the embodiment of FIG. 4B, the cathode (404) of the PIN diode (401) is schematically depicted as not operably connected to the anode (405) of the FED active switching device (402). In FIG. 4B the PIN diode (401) anode (406) is operably coupled to the cathode (407) of the FED active switching device (402). The integrated PIN switch (410) functions in the ON state when suitable potentials are applied to each of the PIN diode cathode (404) and to the FED active switching device anode (405). For example, application of a negative potential to the PIN diode cathode (404) and a positive potential to the FED active switching device anode (406) substantially initiates electron flow at the cathode (404) of the PIN diode (401), and induces electron flow through each of the respective devices. Other methods of providing suitable operating potentials may include operably coupling one of the PIN diode cathode (404) and FED active switching device anode (405) to a ground reference.

Figure 5A:
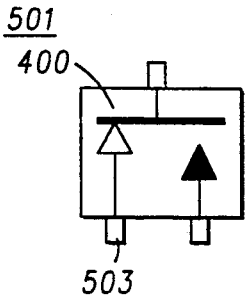
FIG. 5A is a representation of a first packaged configuration of a PIN diode with integral FED switch in accordance with the present invention.

FIG. 5A depicts a device package (501) having a plurality of interconnection regions (503) through which operable coupling may be made from outside circuitry to circuitry that resides within the device package (501). In the instance of the device package (501) of FIG. 5A, the plurality of interconnection regions (503) are shown schematically to connect internally to a PIN diode switch (400) that has been described previously with reference to FIG. 4A. An alternative realization to the integrated PIN switch (400) is to provide a discrete PIN diode and an FED switching device within a single device package such that an overall device functions as an integrated structure.

Figure 5B:
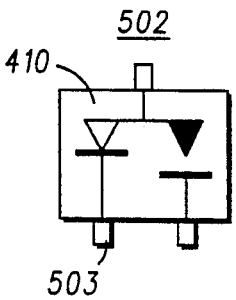
FIG. 5B is a representation of a second packaged configuration of a PIN diode with integral FED switch in accordance with the present invention.

FIG. 5B depicts a device package (502) such as that described previously with reference to FIG. 5A, wherein the plurality of interconnection regions (503) are shown schematically to connect internally to a PIN diode switch (410) that has been described previously with reference to FIG. 4B.

Figure 6:
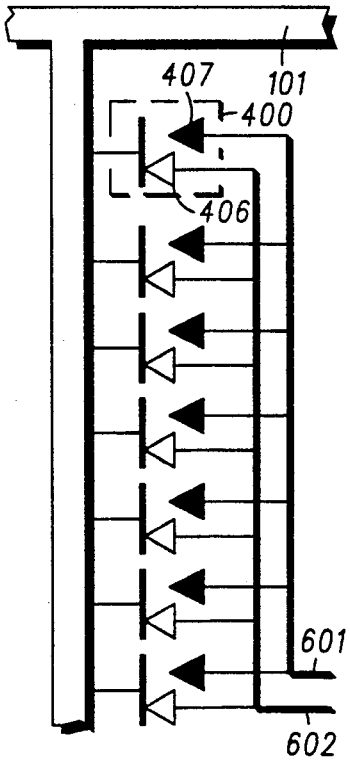
FIG. 6 is a schematic representation of a first embodiment of an application of a plurality of PIN diodes with integral FED switches in accordance with the present invention.

FIG. 6 is a schematic representation of a first electronic circuit utilizing a plurality of integrated PIN diode switches (400), described individually previously with reference to FIG. 4A, wherein each of the plurality of integrated PIN diode switches (400) is operably coupled to a transmission line conductor (101). Each FED cathode (407) of the plurality of integrated PIN diode switches (400) is operably coupled to at least a first conductive line of a first group of conductive lines (601), herein depicted as a bus line. Each PIN diode anode (406) of the plurality of integrated PIN diode switches (400) is operably coupled to at least a first conductive line of a second group of conductive lines (602). Operable connection of the PIN diode anodes (406, . . . ) and the FED cathodes (407, . . . ) of each of the plurality of PIN diode switches (400) as described provides a means for selectively placing selected PIN diode switches in the ON state. Operation of the first electronic circuit, depicted schematically in FIG. 6, as described above, provides a method for electronically modifying and apparent length of a segment of a transmission line conductor to which the first electronic circuit is connected. By selectively placing PIN diode switches of the plurality of PIN diode switches (400) into an ON state, a low impedance is presented to the transmission line conductor (101), as described previously with reference to FIG. 1 and FIG. 3A. As such, the circuit may be usefully employed as a variable transmission line length tuning element for applications such as, for example, adaptive tuning. An alternative embodiment (not shown) may employ a single integrated PIN diode switch (400) and a plurality of PIN diode devices, operably coupled as described, wherein each PIN diode device may be selectively energized to the ON state by providing a suitable potential to the single PIN diode switch (400) and a suitable potential to a selected PIN diode device.

Figure 7A:
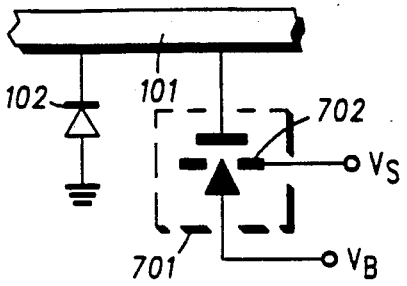
FIG. 7A is a schematic representation of a third embodiment of a PIN diode with FED switch in accordance with the present invention.

FIG. 7A is a schematic representation of a third embodiment of a PIN diode switch in accordance with the present invention, wherein an active switching FED device (701) having first, second, and third device terminals is employed. The first device terminal of the active switching FED device (701) is operably coupled to the transmission line conductor (101). A PIN diode (102) having first and second PIN diode device terminals is provided, wherein the first PIN diode device terminal of the PIN diode (102) is operably coupled to the transmission the conductor (101). The second PIN diode device terminal of the PIN diode (102) is operably coupled to a ground reference. The third device terminal of the active switching FED device (701) operably couples a gate extraction electrode (702) to an externally provided signal source/potential. When the second device terminal of the active switching FED device (701) is operably coupled to a selected externally provided potential, herein referenced as $V_B$, and the third device terminal of the active switching FED device (701) is operably coupled to a second selected externally provided potential, herein referenced as $V_S$, the active switching FED device (701) is placed in the ON state, providing current flow through the operably coupled PIN diode (102) such that the PIN diode (102) placed in the low impedance ON state. A low impedance of the ON PIN diode (102) is presented to the transmission line conductor (101) at the location where the PIN diode (102) is operably coupled to the transmission line conductor (101). The switched ON PIN diode switch that employs an active switching FED device (701) as described previously with reference to FIG. 7A will perform substantially in a manner like that of the switch described previously with reference to FIG. 1, but not requiring an attendant high frequency energy isolation network such as described and utilized previously with reference to FIG. 1 and FIG. 2. The operating characteristics of FEDs include a high isolation capability. As such, FEDs may be employed in circuits without the need to provide high frequency isolation in addition to, and as protection for, a switching device, as is required for switching circuits employing bipolar and semiconductor field-effect transistor devices.

Figure 7B:
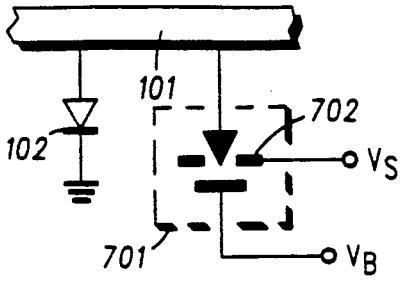

FIG. 7B is a schematic representation of a fourth embodiment of a PIN diode switch in accordance with the present invention wherein the PIN diode (102) is operably coupled to the transmission line conductor (101) with device terminals arranged opposite to the manner of operable coupling of the PIN diode (102) described previously with reference to FIG. 7A. Further, the active switching FED device (701) is depicted in FIG. 7B with device terminals oppositely operably coupled to the transmission line conductor (101) compared to the active switching FED device (701) previously described with reference to FIG. 7A. So coupled, the PIN diode switch of FIG. 7B will function substantially in a like manner as described for the switch described previously with reference to FIG. 7A and FIG. 1, provided that the polarity of the externally provided potential, $V_B$, is opposite to the polarity of the externally provided potential, $V_B$, employed in the PIN diode switch described previously with reference to FIG. 7A.

Figure 8A:
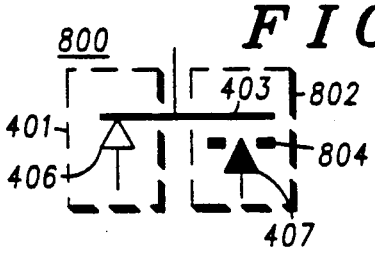
FIG. 8A is a third schematic diagram of a PIN diode with integral FED switch in accordance with the present invention.

FIG. 8A is a schematic diagram of a third embodiment of an integrated PIN switch (800) employing a PIN diode (401) and and FED active switching device (802). In the embodiment of FIG. 8A, the cathode of the PIN diode (401) is schematically depicted as being operably coupled to an anode of the FED active switching device (402) by a common schematic diagram element (403). The FED active switching device (802) is further provided with a gate extraction electrode (804). An integrated PIN diode switch constructed in accordance with the depiction of FIG. 8A will function in the ON state when suitable potentials are applied. For example, application of a first selected positive potential to the PIN diode anode (406), a selected negative potential to the FED active switching device cathode (407), and a second selected positive potential to the FED active switching device gate extraction electrode (804), provides electron flow, substantially initiated at the cathode (407) of the FED active switching device (402), and induces electron flow through each of the FED and PIN devices. Other methods of providing suitable operating potentials may include operably coupling one of the pin diode anode (406) and FED active switching device cathode (407) to a ground reference.

Figure 8B:
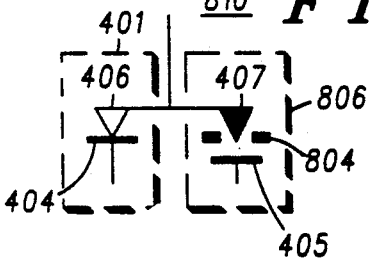
FIG. 8B is a fourth schematic diagram of a PIN diode with integral FED switch in accordance with the present invention.

FIG. 8B is a schematic diagram of a fourth embodiment of an integrated PIN switch (810) employing a PIN diode (401) and an FED active switching device (806) in accordance with the present invention. In the embodiment of FIG. 8B the cathode (404) of the PIN diode (401), as schematically depicted, is not operably connected to the anode (405) of the FED active switching device (806). In FIG. 8B the anode (406) of the PIN diode (401) is operably coupled to the cathode (407) of the FED active switching device (806). The integrated PIN switch (810) will function in the ON state when suitable potentials are applied to each of the PIN diode cathode (404), the FED active switching device anode (405), such as for example a positive potential, and the FED active switching device gate extraction electrode (804). For example, application of a predetermined negative potential to the PIN diode cathode (404), a first predetermined positive potential to the FED active switching device anode (405), and a second predetermined positive potential to the FED active switching device gate extraction electrode (804) provides electron flow, substantially initiated at the cathode (404) of the PIN diode (401), and induces electron flow through each of the PIN and FED devices. Other methods of providing suitable operating potentials may include operably coupling one of the PIN diode cathode (404) and FED active switching device anode (405) to a ground reference.

Figure 9A:
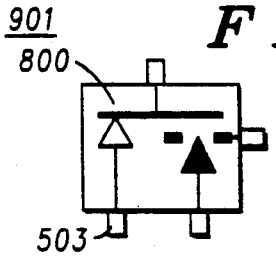
FIG. 9A is a representation of a third packaged configuration of a PIN diode with integral FED switch in accordance with the present invention.

FIG. 9A depicts a third embodiment of a device package (901) as described previously with respect to FIG. 5A that further schematically represents a resident integrally formed PIN diode switch employing an active switching FED device as described previously with reference to FIG. 8A and has at least one interconnection region of the plurality of interconnection regions (503) operably coupled to a gate extraction electrode such that an integrally formed device contained therein may operate as described previously with reference to FIG. 7A.

Figure 9B:
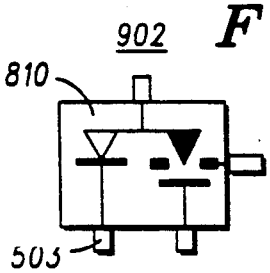
FIG. 9B is a representation of a fourth packaged configuration of a PIN diode with integral FED switch in accordance with the present invention.

FIG. 9B. depicts a device package (912) such that, as described previously with reference to FIG. 5A, the plurality of interconnection regions (503) are connected internally, shown schematically, to a PIN diode switch (410) which has been described previously with reference to FIG. 4B.

Figure 10:
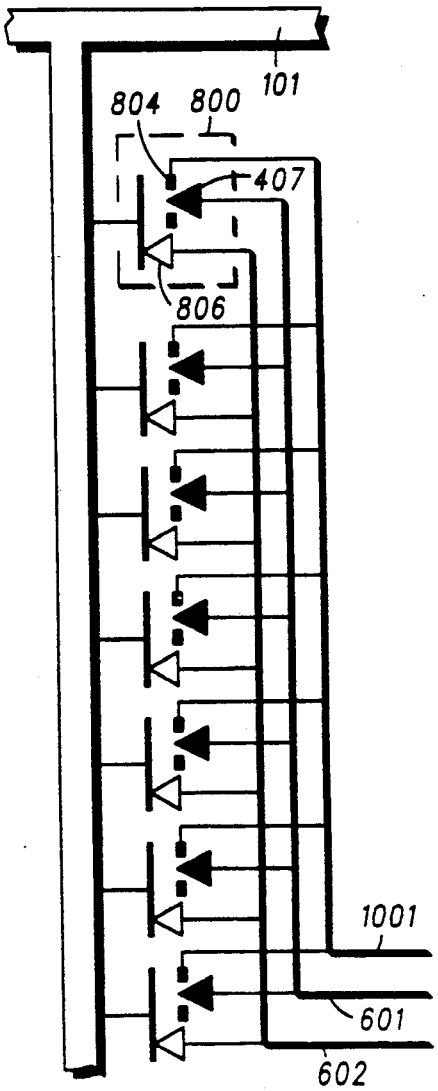
FIG. 10 is a schematic representation of a second embodiment of an application of a plurality of PIN diodes with integral FED switches in accordance with the present invention.

FIG. 10 is a schematic representation of a second electronic circuit having a plurality of integrated PIN diode switches (800), described previously with reference to FIG. 8A, wherein each of the plurality of integrated PIN diode switches (800) is operably coupled to a transmission line conductor (101) in accordance with the present invention. Each FED cathode (407) of the plurality of integrated PIN diode switches (800) is operably coupled to at least a first conductive line of a first group of conductive lines (601), herein depicted as a first bus line. Each PIN diode anode (806) of the plurality of integrated PIN diode switches (800) is operably coupled to at least a first conductive line of a second group of conductive lines (602), herein depicted as a second bus line. Each FED gate extraction electrode (804) of the plurality of integrated PIN diode switches (800) is operably coupled to at least a first conductive line of a third group of conductive lines (1001), herein depicted as a third bus line. Operable connection of each of the plurality of PIN diode switches (800) as described provides a means for selectively placing selected PIN diode switches of the plurality of PIN diode switches in the ON state. Operation of the electronic circuit, depicted schematically in FIG. 10, as described will provide a method for electronically modifying an apparent length of the transmission line segment of the transmission line conductor with which it is associated. By selectively placing PIN diode switches of the plurality of PIN diode switches (800) into the ON state, a low impedance is presented to be the transmission line conductor (101) as described previously with reference to FIG. 1 and FIG. 3A. An alternative embodiment (not shown) may employ a single integrated PIN diode switch (800) and a plurality of PIN diode devices, operably coupled as described, wherein each PIN diode device may be selected energized to the ON state by providing suitable potentials to the single PIN diode switch (800) and a suitable potential to a selected PIN diode device.

It is anticipated that the integral PIN diode switches described in the application of FIG. 10 may also employ the alternative embodiment integral PIN diode switch described previously with reference to FIG. 8B. Further, it is anticipated that a plurality of distinct integral PIN diode switches employing active switching FED devices may be realized within a single package wherein the corresponding PIN diodes and FEDS may be integrated onto a single die.

It is also anticipated that field emission devices employing additional device elements, such as four or more, may be used to provide similar switching circuits.

I claim:

1. An impedance switching circuit comprising:

A) a first transmission line conductor;

B) a first PIN diode having first and second PIN diode device terminals, wherein the first PIN diode device terminals is operably coupled to the first transmission line conductor, and wherein the second PIN diode device terminal is operably coupled to a first externally provided potential; and C) a first-field emission having at least first and second device terminals, wherein the first device terminal is operably coupled to the first transmission line conductor, and wherein the second device terminal is operably coupled to a second externally provided potential.

2. An integrated impedance switching device comprising:

A) a diode having first and second PIN diode terminals; and

B) a field emission device having first and second device terminals, wherein one of the first and second device terminals is operably coupled to one of the first and second PIN diode terminals.

3. The integrated impedance switching device of claim 2, wherein the PIN diode and the field emission device are disposed on one substrate.

4. An integrated impedance switching device comprising:

A) a plurality of PIN diodes each having first and second PIN diode terminals; and B) a field emission device having first and second device terminals, wherein one of the first and second device terminals is operably coupled to some of the first and second PIN diode terminals.

5. A monolithic integrated impedance switching device comprising:

A) a device package having a plurality of interconnection regions;

B) a PIN diode substantially disposed within the device package and having first and second PIN diode terminals, one of which is operably coupled to some of the plurality of interconnection regions; and C) a field emission device, substantially disposed within the device package and having first and second device terminals, one of which is operably coupled to some of the plurality of interconnection regions.

6. An impedance switching circuit comprising:

A) a transmission line conductor;

B) a PIN diode having first and second PIN diode terminals, wherein the first PIN terminal is operably coupled to the transmission line conductor and wherein the second PIN diode terminal is constructed to be coupled to a first externally provided potential; and C) a field emission device having at least first, second, and third device terminals wherein the first device terminal is operably coupled to the transmission line conductor, and wherein the second and third device terminals are constructed to be operably coupled to further externally provided potentials.

7. An integrated impedance switching device comprisng:

A) a PIN diode having first and second PIN diode terminals; and

B) a field emission device having first, second, and third device terminals wherein some of the first, second, and third device terminals of the field emission device are operably coupled to one of the first and second PIN diode terminals of the PIN diode.

8. The integrated impedance switching device of claim 7, wherein the PIN diode and the field emission device are located on a single substrate.

9. An integrated impedance switching device comprising:

A) a plurality of PIN diodes each having first and second PIN diode; terminals; and B) a first field emission device having first, second, and third device terminals, wherein some of the first, second, and third device terminals of the field emission device are operably coupled to some of the first and second PIN diode terminals of the plurality of PIN diodes.

10. A monolithic integrated impedance switching device comprising:

A) a device package having a plurality of interconnection regions;

B) a PIN diode substantially disposed within the device package and having first and second PIN diode terminals one of which is operably coupled to some of the plurality of interconnection regions; and C) a field emission device substantially disposed within the device package and having first, second, and third device terminals some of which are operably coupled to some of the plurality of interconnection regions.

11. An adaptively tunable electronic circuit comprising:

A) a transmission line conductor;

B) a plurality of conductive lines; and

C) a plurality of integrated impedance switching devices each including a PIN diode having first and second PIN diode terminals, and a field emission device having first and second device terminals, wherein one of the first and second device terminals is operably coupled to one of the first and second PIN diode terminals and further having a plurality of interconnection regions, some of the plurality of interconnection regions being operably coupled to the transmission line conductor and selected other of the plurality of interconnection regions being each selectively operably coupled to a first conductive line of the plurality of conductive lines, such that by selectively placing at least one of the plurality of integrated impedance switching devices into an ON state, an effective electrical length of the transmission line conductor is altered.

12. The adaptively tunable electronic circuit of claim 11, wherein the plurality of integrated impedance switching devices are disposed on one substrate.

* * * * *